US006136391A

United States Patent [19]

Lehman

[11] Patent Number: 6,136,391

[45] Date of Patent: Oct. 24, 2000

[54] REVERSE TWIST MULTI-STRAND GARLAND AND METHOD OF MAKING SAME

[75] Inventor: William L. Lehman, Whitelaw, Wis.

[73] Assignee: Santa's Best, Northfield, Ill.

[21] Appl. No.: 09/203,659

[22] Filed: Dec. 2, 1998

Related U.S. Application Data

[63] Continuation-in-part of application No. 29/085,017, Mar. 16, 1998, Pat. No. Des. 407,992, and application No. 29/095,227, Oct. 19, 1998, Pat. No. Des. 420,937.

[51] Int. Cl.[7] ..... A47G 33/04; G09F 17/00; G09F 19/00

[52] U.S. Cl. ..... 428/10; 428/222; 428/7; 428/542.6; 493/958

[58] Field of Search ..... 428/5, 7, 10, 37, 428/222, 542.6; 493/956, 958, 386

[56] References Cited

U.S. PATENT DOCUMENTS

| | | |
|---|---|---|
| D. 250,101 | 10/1978 | Bartels et al. . |
| 1,659,584 | 2/1928 | Willis . |
| 1,773,580 | 8/1930 | Franke . |
| 1,904,471 | 4/1933 | Kelman . |
| 2,880,540 | 4/1959 | Williams . |
| 3,453,170 | 7/1969 | Jason . |
| 3,484,329 | 12/1969 | Boisse . |
| 3,584,449 | 6/1971 | Pollard . |
| 3,607,508 | 9/1971 | Ha, Jr. . |
| 3,637,452 | 1/1972 | Sanders . |
| 4,679,392 | 7/1987 | Nakagawa . |
| 4,789,571 | 12/1988 | Kinderman et al. . |
| 4,964,932 | 10/1990 | Miller . |
| 5,091,226 | 2/1992 | Protz, Jr. . |

OTHER PUBLICATIONS

Santa's Best 1997 Catalog, pp. 26, 31, 43 (no month).

*Primary Examiner*—Deborah Jones
*Assistant Examiner*—Wendy Boss
*Attorney, Agent, or Firm*—Emrich & Dithmar

[57] ABSTRACT

A garland is produced by providing plural strips, each including one or more plies of web, with each web ply having two laterally spaced arrays of longitudinally spaced lateral slits defining arrays of lateral slats joined at the their inner and outer ends. Each strip is twisted with one or more associated support filaments in a predetermined direction to form adjacent helical coils. Plural ones of the twisted strands are then twisted together in the opposite direction to produce an elongated rope which includes adjacent spiral bands all turning in a first direction about the longitudinal axis, with each band including a plurality of generally tubular sections arranged side-by-side, with each section forming a segment of a spiral turning in an opposite direction relative to the axis.

18 Claims, 4 Drawing Sheets

REVERSE TWIST MULTI-STRAND GARLAND AND METHOD OF MAKING SAME

CROSS REFERENCE TO RELATED APPLICATIONS

This application is a continuation-in-part of application Ser. No. 29/085,017, filed Mar. 16, 1998 now U.S. Pat. No. D 407,992, and of application Ser. No. 29/095,227, filed Oct. 19, 1998 now U.S. Pat. No. D 420,937.

BACKGROUND OF THE INVENTION

The present invention relates generally to decorative garlands and methods of making same. More particularly, the invention is directed to garlands constructed from a cut or slit film web which is twisted together with a supporting wire or filament.

Decorative garlands formed from twisted cut film have been made for many years in a variety of different styles and designs. One such garland type and a method for making it are disclosed in U.S. Pat. No. 5,091,226. The method starts by providing a flexible web of film and cutting it to provide a predetermined pattern of transverse slits. The slit film web is then folded and twisted together with one or more elongated supporting wires, wherein the slit web is fed into the twisting mechanism much faster than the supporting wires. The resulting garland has a plurality of bunched-together loops or spikes or needles, depending upon the pattern of the slitting in the web.

It is also known to take two of such garland strands made in accordance with U.S. Pat. No. 5,091,226, the garland strands preferably being of different color, and twisting them together in a direction opposite from the twist direction used in forming each garland strand, to produce a combined garland with a helically-striped barber pole appearance. In such combined garlands the individual strands retain substantially their same external appearance.

Referring to FIG. 1, there is illustrated another type of prior art garland. The method of forming it is very similar to that of the aforementioned U.S. Pat. No. 5,091,226, the difference being in the pattern of slitting of the starting web 11. More specifically, referring to FIG. 3, the web 11 has two laterally spaced arrays 12 and 12*a* of longitudinally spaced lateral slits 13, 13*a* forming rows of slats 14, 14*a*. The web also has an unslit central region 15 separating the two arrays of slats and unslit marginal regions 16 and 17. When the web is twisted in a predetermined direction with its associated supporting wire 18 (see FIG. 2), one array of slats 14 is formed into an array of loops 20, while the other array of slats 14*a* is formed into an array of loops 21, the loop arrays respectively defining adjacent helical tubes 22 and 23. In order to provide adequate support and rigidity, plural plies 11, 11*a* of the slit web may be stacked to provide a multi-ply strip 25 before twisting with the associated support wires (see FIG. 6). In this case, the loops 20, 20*a*, 21, 21*a* and tubes 22, 22*a*, 23, 23*a* formed by the adjacent webs 11, 11*a* are respectively formed coaxially within one another (see FIG. 2).

Applicant has discovered that plural ones of these garland strands can be combined in a reverse twist fashion to produce a combined garland such that, in the combined garland, each of the constituent strands has an appearance quite different from its appearance before it was combined, resulting in a unique garland pattern.

SUMMARY OF THE INVENTION

It is a general object of the invention to provide a decorative garland which affords important advantages over prior garlands.

An important feature of the invention is the provision of a decorative garland which affords a unique decorative pattern.

In connection with the foregoing feature, a further feature of the invention is the provision of a decorative garland of the type set forth, which can be formed of known, preexisting garland constituents.

Yet another feature of the invention is the provision of a garland of the type set forth, which can be produced by using known techniques.

Still another feature of the invention is the provision of a method of forming a unique garland of the type set forth.

Certain ones of these and other features of the invention may be attained by providing a decorative garland comprising an elongated rope including plural strands twisted together in continuous adjacent spirals; each of the strands including an elongated, thin, flexible web and a support filament, with the web having two laterally spaced arrays of longitudinally spaced lateral slits defining arrays of lateral slats joined at their inner and outer ends, the web being twisted with its filament so that each slat forms a loop and each array of slats forms an array of loops with the two arrays of loops respectively forming adjacent spiral tubes, wherein the strands of the rope are twisted together in a direction opposite the direction in which the web of each strand is twisted.

Further features of the invention may be attained by providing a decorative garland comprising an elongated rope including plural adjacent spiral bands all turning in a first direction about a longitudinal axis, each band including a plurality of generally tubular sections arranged side-by-side, with each section forming a segment of a spiral turning in a second direction opposite said first direction relative to the axis.

Still other features of the invention may be attained by providing a method of making a decorative garland comprising providing plural thin flexible webs, each having two laterally spaced arrays of longitudinally spaced lateral slits defining arrays of lateral slats joined at their inner and outer ends, providing plural support filaments respectively corresponding to the webs; converting each web and its associated support filament to a twisted strand to produce plural twisted strands, the converting including twisting the web together with its associated support filament in a first predetermined direction and twisting the plural twisted strands together in a second direction opposite the first direction.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
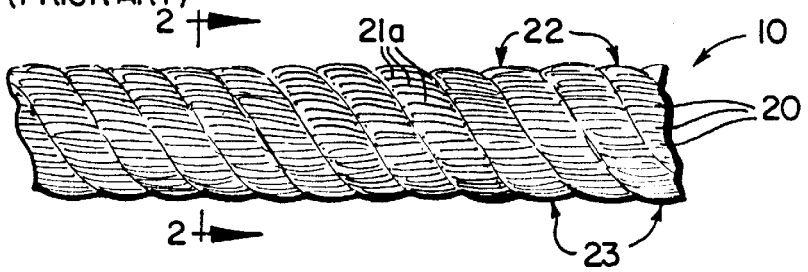
FIG. 1 (PRIOR ART)
FIG. 1 is a side elevational view of a length of a prior art garland.
Figure 3:
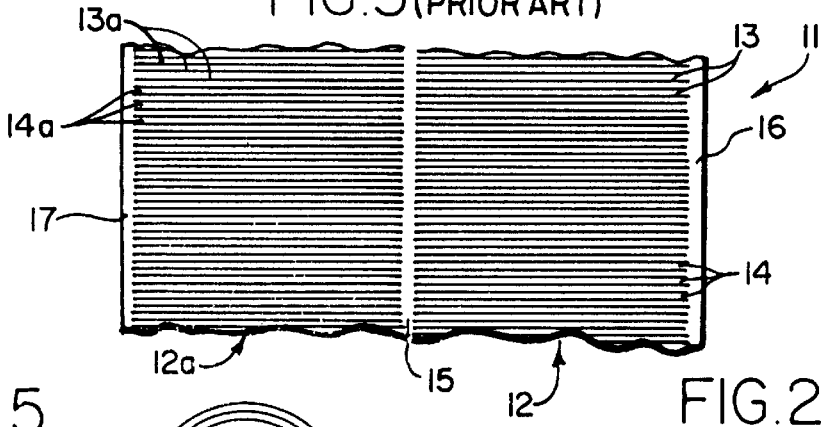
FIG. 3 (PRIOR ART)
FIG. 3 is an enlarged, fragmentary, top plan view of a length of slitted web used to form the garland of FIG. 1.
Figure 2:
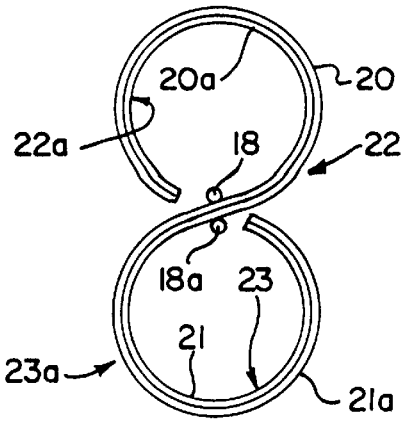
FIG. 2 (PRIOR ART)
FIG. 2 is an enlarged diagrammatic illustration of a section taken generally along the line 2—2 of FIG. 1.

Referring to FIGS. 1–3, there is illustrated a prior art decorative garland 10, which is formed from one or more plies of a slitted web 11. The web 11 could be formed of various materials, such as plastics, nylon or the like, but is preferably formed of a rigid PVC material. The web 11 has two laterally-spaced and longitudinally extending arrays 12 and 12*a* of lateral or transverse slits 13, 13*a*, the slits preferably being equidistantly spaced and cooperating to define arrays of thin slats 14, 14*a*. The two arrays of slats are spaced apart by a longitudinally extending, unslit, central region 15 and the laterally outer ends of the slats are joined by unslit, longitudinally extending marginal regions 16 and 17.

Figure 6:
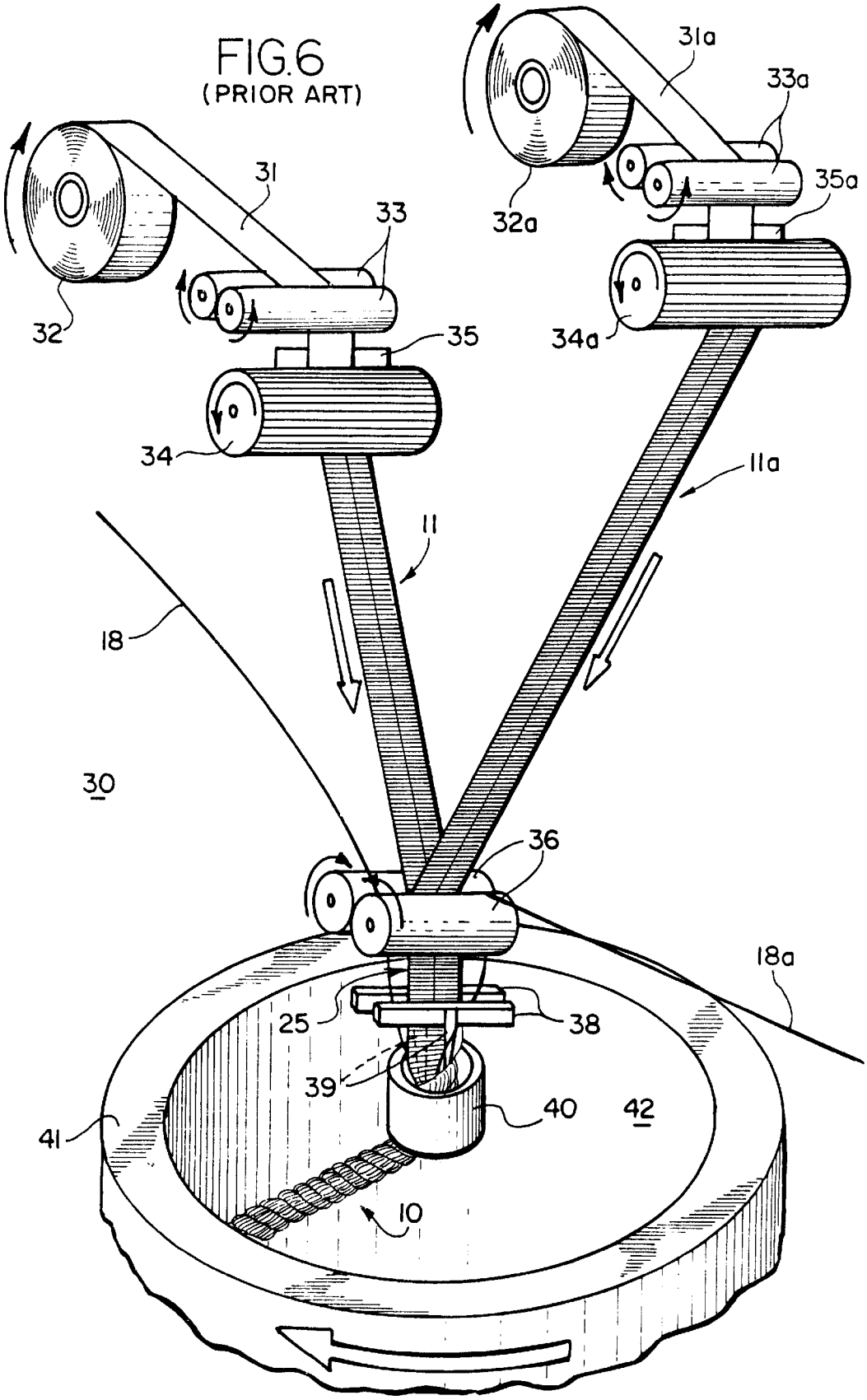
FIG.6 (PRIOR ART)
FIG. 6 is a fragmentary, perspective view of apparatus used to form a garland of the type illustrated in FIG. 1.

For purposes of illustration, the garland 10 is formed of two plies of the web 11 to provide added body and strength, although it will be appreciated that the same type of garland could be formed with a single web ply or more than two plies, depending upon the materials used and the particular garland application. Referring to FIG. 6, the two plies of slit web are, respectively, designated 11 and 11*a* and they are, respectively, provided with support filaments 18, 18*a*, which are preferably formed of thin metal wire, the preferred wire being a relatively soft or "bead" metal, such as zinc. The web plies 11, 11*a* and their associated support filaments 18, 18*a* are combined to form a plural-ply strip 25 with the filaments 18, 18*a* extending centrally down opposite sides of the strip 25, and are twisted together in the apparatus 30 to form the garland 10.

Referring in particular to FIGS. 1–3 and 6, during the twisting process the marginal regions 16 of the web plies curl over along one side of the strip 25 toward the central regions 15, while the marginal regions 17 curl over along the opposite side of the strip 25 toward the central regions 15, so that the slats 14, 14*a* of each web ply respectively form loops. More specifically, the slats 14, 14*a* of the web ply 11 respectively form loops 20, 21, while the slats 14, 14*a* of the web ply 11*a* respectively form loops 20*a* and 21*a*, with the loops 20*a* being respectively disposed inside the loops 20 and the loops 21 being respectively disposed inside the loops 21*a*, as seen in FIG. 2. The array of nested loops 20, 20*a* cooperate to define a helical tube 22, while the array of nested loops 21, 21*a* cooperate to define a helical tube 23 (FIG. 1). The two helical tubes 22, 23 are adjacent to each other, so that the convolutions of one helix alternately nest between the convolutions of the other helix.

Referring further to FIG. 6, in the operation of the apparatus 30, two film plies 31, 31*a* are, respectively, uncoiled from supply rolls 32, 32*a* by sets of feed rollers 33, 33*a* and are then fed between cutting rollers 34, 34*a* and associated cutter bars 35, 35*a* to slit the film plies in the pattern illustrated in FIG. 3. Preferably, each cutting roller has axially extending cutting blades which cooperate with the associated cutter bar to slit the web, each cutter bar preferably being provided with notches or grooves located to prevent cutting in the central and marginal regions 15–17. The slit web plies 11, 11*a* are then fed through feed rollers 36 along with the support filaments 18, 18*a*, which are respectively fed from associated supplies (not shown), to form the strip 25. The strip 25 is fed between a pair of guide bars 38, respectively provided with depending, elongated, tapered guide fingers 39 which project downwardly into a cylindrical bushing 40. The leading end of the strip 25 exits the bottom of the bushing 40 and moves by centrifugal force to the inner cylindrical side surface 42 of a rotating collection drum 41, which is coaxial with the bushing 40. The rotation of the drum effects twisting of the strip 25, so that the opposite sides thereof are, respectively, twisted around the guide fingers 39 to produce the garland 10, all in a known manner. In the apparatus 30 of FIG. 6, the garland 10 is produced with a "left-hand" twist by rotation of the drum 41 in a clockwise direction, as viewed from the top, as indicated by the arrow. However, it will be appreciated that the garland could also be produced with a "right-hand" twist, by reversing the positions of the guide fingers 39 and rotating the drum 41 in the opposite direction.

A fundamental aspect of the present invention is that applicant has recognized that plural ones of the garland 10, hereinafter referred to as garland strands, can be combined so as to produce a garland wherein each of the combined strands assumes a different external appearance. More particularly, in accordance with the present invention, two or more of the garland strands 10, all of which have the same twist direction, can be combined by twisting them together in the opposite direction, by using essentially the same twisting mechanism used in the apparatus 30.

Figure 7:
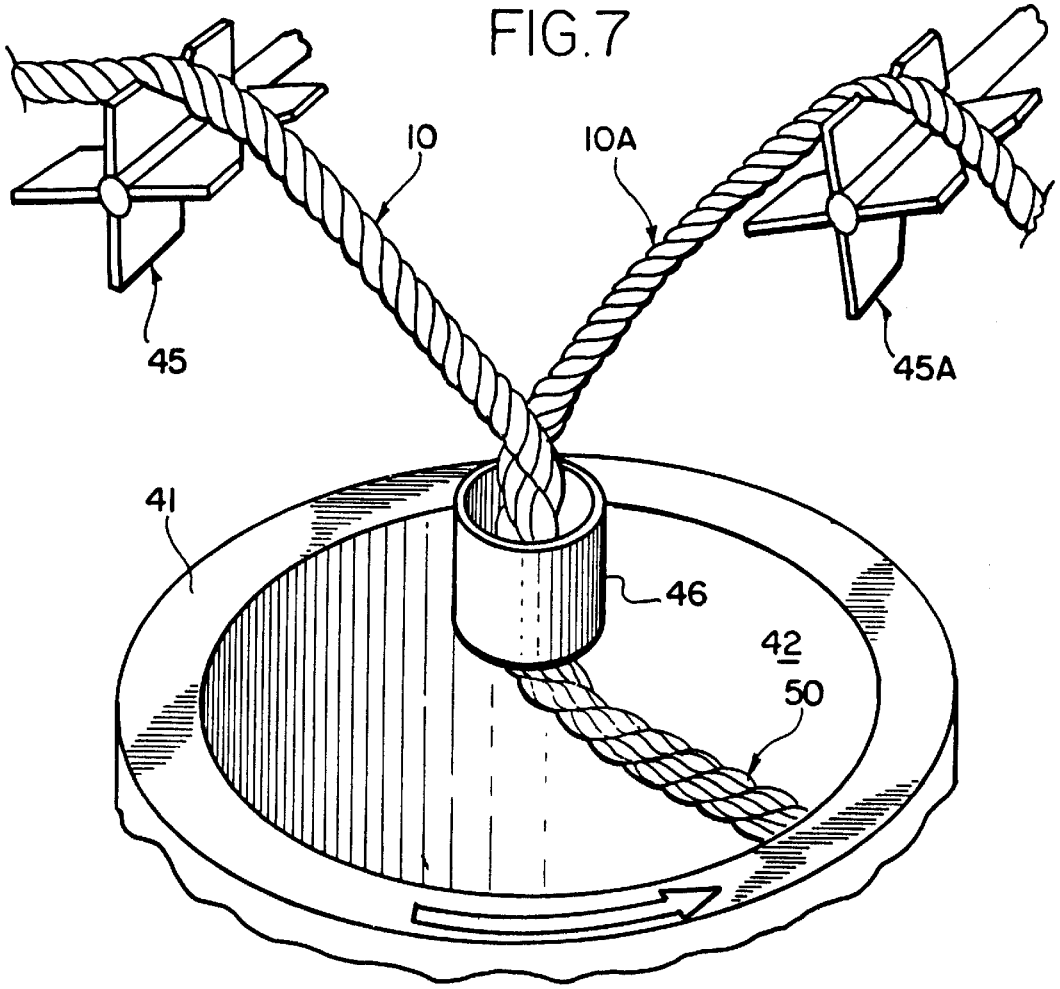
FIG. 7 is a view similar to FIG. 6 of apparatus used in forming the garland of FIG. 4.

Referring to FIG. 7, two strands of garland, respectively designated 10 and 10A, both produced with left-hand twist in accordance with FIG. 6, are respectively metered by means of notched paddle wheels 45, 45*a* through a bushing 46 and thence downwardly into the coaxial collection drum 41. The leading ends of the garland strands 10, 10A move to the inner side surface of the drum 41 by means of centrifugal force in the normal manner as the drum is rotated in a counterclockwise direction to twist the two strands 10 and 10A together with a right-hand twist, to produce a combined garland 50 in accordance with the present invention.

Figure 4:
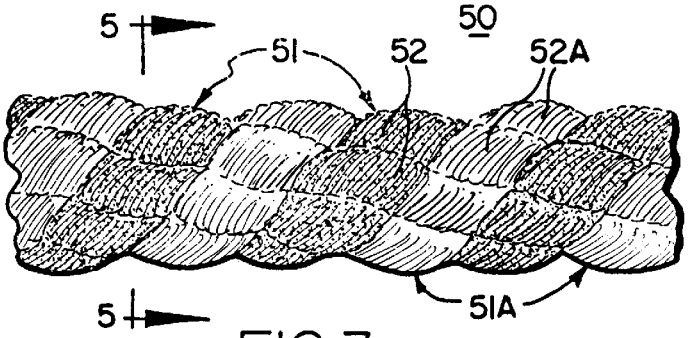
FIG. 4 is a view similar to FIG. 1 of a length of a garland in accordance with the present invention.
Figure 9:
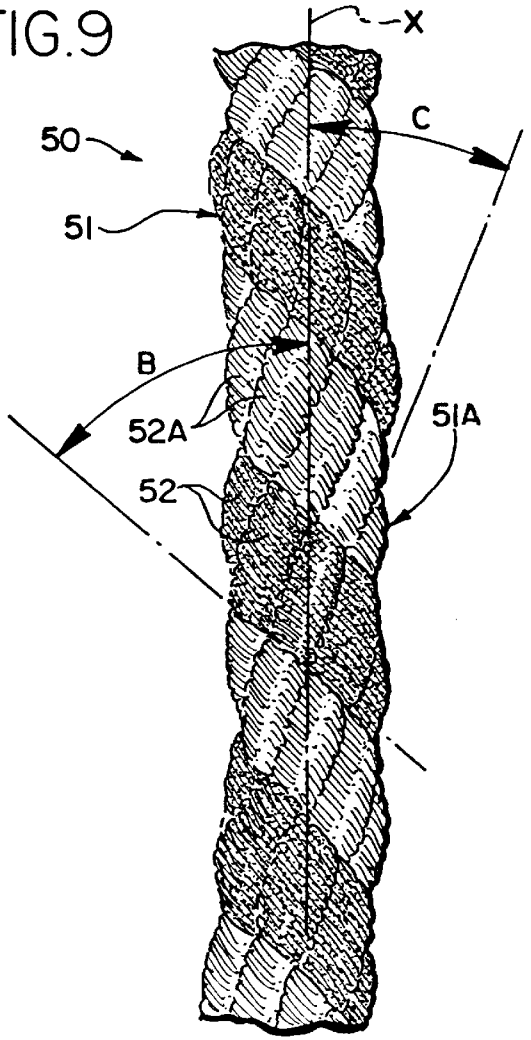
FIG. 9 is a view similar to FIG. 4, rotated 90°, of a length of garland in accordance with the present invention.

The garland 50 has a unique garland pattern which produces a unique external appearance, which can be better see in FIGS. 4 and 9. The two garland strands 10, 10A, respectively produce adjacent spiral or helical bands 51 and 51A. However, because of the reverse twisting effect, the spiral tubes of the garland strand 10 appear as adjacent short tubular sections 52, and the spiral tubes of the garland strand 10A appear as short tubular sections 52A in the combined garland 50, with each of the tubular sections 52 and 52A curving in a helical direction opposite that of the bands 51, 51A which they make up, relative to the longitudinal axis X of the combined garland 50. Also, the tubular sections 52 of the band 51 are, respectively, disposed substantially end-to-end with tubular sections 52A of adjacent coils or convolutions of the band 51A to produce an array of axially adjacent, right-hand twist helices, each made up of alternating tubular sections 52 and 52A.

Figure 8:
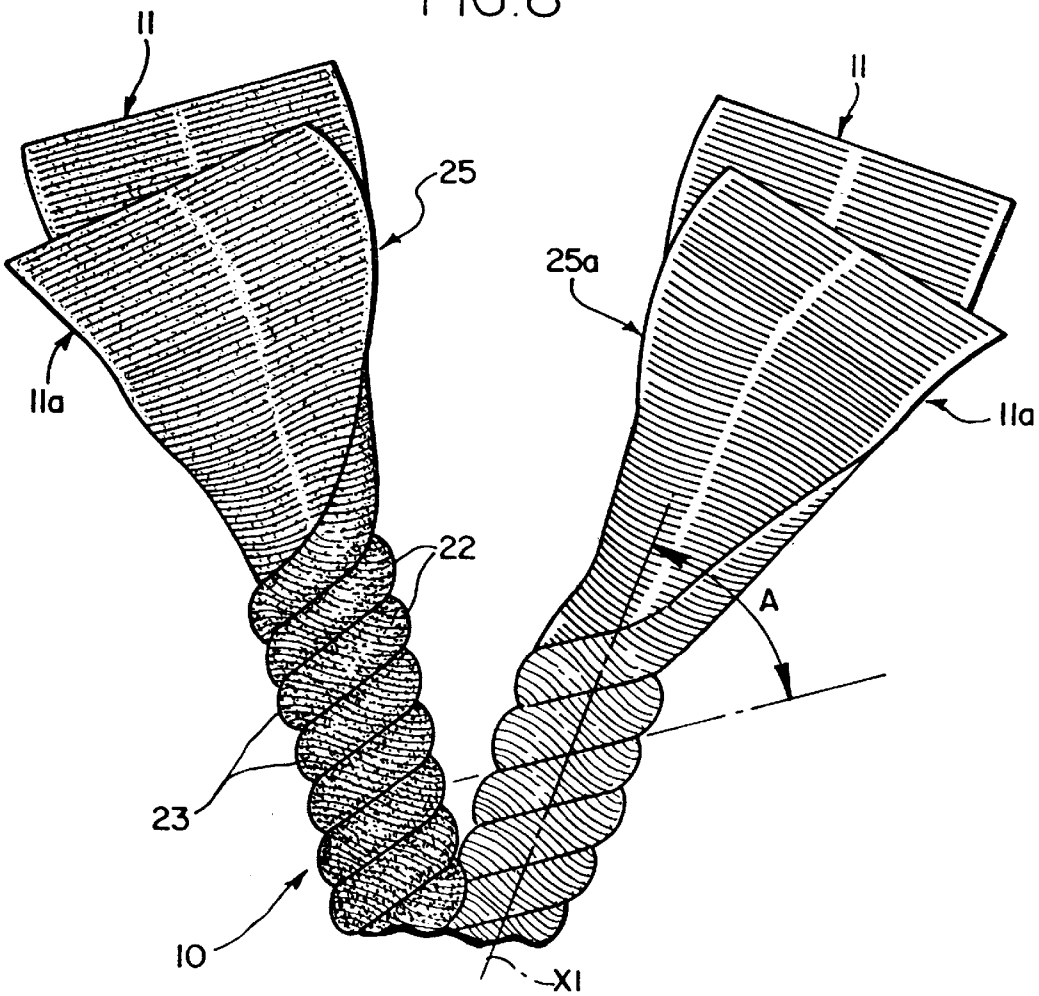
FIG. 8 is an enlarged, fragmentary, side elevational composite view of portions of the constituent garland strands used to make the garland of FIG. 4.

FIG. 8 is a composite view which essentially combines portions of the processes illustrated in FIGS. 6 and 7. As can be seen, two garland strands 10, 10A are shown essentially as they would be entering the bushing 46 of FIG. 7. The garland strands are, respectively, formed of twisted strips 25, 25*a*, each made up of two plies of slit web 11, 11*a*. It will be appreciated that the individual garland strands 10 and 10*a* and the combined garland 50 can have different sizes and tightnesses of twist, depending upon the size of initial slit web used, the materials used and the like.

Preferably, the webs are chosen such that each of the garland strands 10 and 10A has a helical twist such that each convolution of each helix is inclined with respect to the longitudinal axis X' of the strand at a helix angle A, which is in the range of from about 45° to about 65°, and preferably about 55°. In the combined or finished garland 50, each of the helical bands 51, 51A has a helix angle B in the range of from about 40° to about 60°, and preferably about 50°, and each of the tubular sections 52, 52A has a helix angle C in the range of from about 10° to about 30°, and preferably about 20°.

Figure 5:
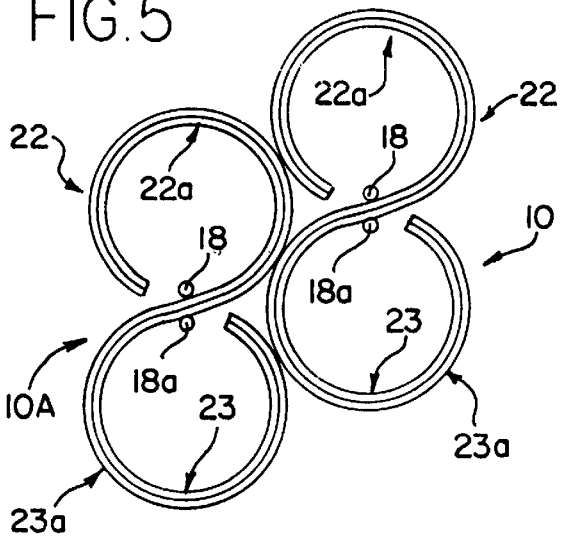
FIG. 5 is an enlarged, diagrammatic illustration of a section taken generally along the line 5—5 in FIG. 4.

As can be seen in FIG. 5, the helical tubes 22 and 23 of the strand 10 respectively nest with the tubes 22 and 23 of the strand 10A because of the reverse twisting, and this results in a unique pattern of helical bands, each made up of reverse-sloped tubular sections.

Figure 10:
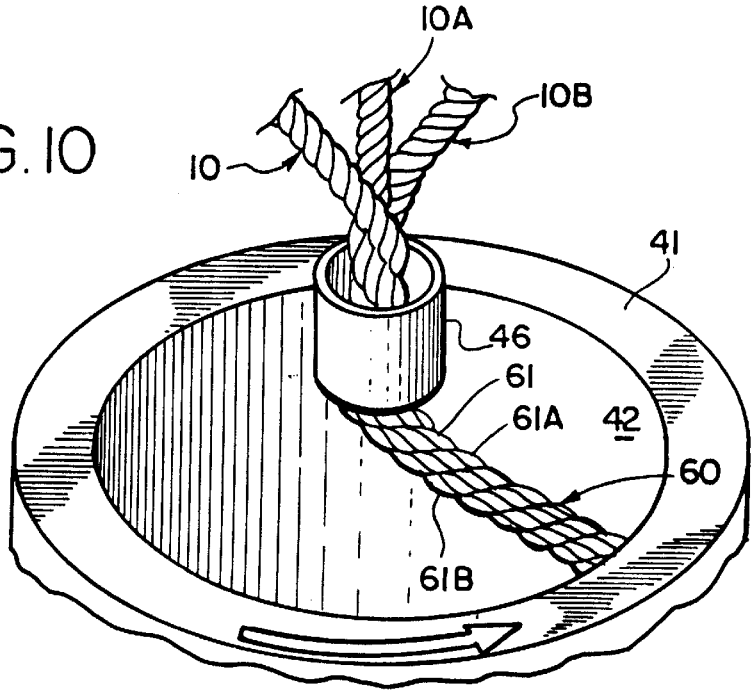
FIG. 10 is a view similar to FIG. 7 of apparatus used in forming a garland in accordance with another embodiment of the present invention.

Referring to FIG. 10, there is illustrated the formation of a combined garland 60 made up of three garland strands 10, 10A and 10B all having the same twist, which are twisted together with a reverse twist using the same apparatus described above for FIG. 7. In this case, the three garland strands 10, 10A and 10B will respectively produce adjacent helical bands 61, 61A and 61B, each made up of tubular sections, in the same manner as described above for the garland 50. It would, of course, be possible to twist together an even larger number of garland strands.

Typically, the garland strands which make up the combined garland 50 or 60 have distinguishing characteristics, such as different colors, material finishes or the like, so that the finished garland 50 or 60 will have a barber pole-type striping effect.

From the foregoing, it can be seen that there has been provided an improved decorative garland and method of making same, which produces a unique garland pattern by combining previously-known garland strands with the use of apparatus which includes existing components.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A decorative garland comprising:

an elongated rope including plural strands twisted together in continuous adjacent spirals;

each of said strands including an elongated, thin, flexible web and a support filament, with the web having two laterally spaced arrays of longitudinally spaced lateral slits defining two arrays of lateral slats joined at their inner and outer ends, the web being twisted with its filament so that each slat forms a loop and each array of slats forms an array of loops with two arrays of loops respectively forming adjacent spiral tubes, wherein the strands of the rope are twisted together in a direction opposite the direction in which the web of each strand is twisted.

2. The garland of claim 1, wherein the rope includes two strands.

3. The garland of claim 1, wherein the rope includes more than two strands.

4. The garland of claim 1, wherein each of said strands includes plural flexible webs and filaments overlapped to form a plural-ply strip, the strip being twisted with its filaments so that the webs respectively form tubes disposed substantially coaxially one within another.

5. The garland of claim 1, wherein said filament is formed of metal wire.

6. The garland of claim 1, wherein each strand includes substantially equal lengths of web and support filament.

7. The garland of claim 1, wherein each of said webs comprises a film.

8. A decorative garland comprising:

an elongated rope including plural adjacent spiral bands all turning in a first direction about a longitudinal axis, each band including a plurality of generally tubular sections arranged side-by-side with each section forming a segment of a spiral turning in a second direction opposite said first direction relative to the axis.

9. The garland of claim 8, wherein said rope includes two of said bands.

10. The garland of claim 8, wherein said rope includes more than two of said bands.

11. The garland of claim 8, wherein each of said bands defines a helix having a slope inclined to the longitudinal axis of the rope at a first predetermined angle in a range of from about 40° to about 60°, each of said tubular sections defining a portion of a helix having a slope inclined to the longitudinal axis of the rope at a predetermined second angle in the range of from about 10° to about 30°.

12. A method of making a decorative garland comprising:

providing plural thin flexible webs, each having two laterally spaced arrays of longitudinally spaced lateral slits defining arrays of lateral slats joined at their inner and outer ends, providing plural support filaments respectively corresponding to the webs, converting each web and its associated support filament to a twisted strand to produce plural twisted strands, the converting including twisting the web together with its associated support filament in a first predetermined direction, and twisting the plural twisted strands together in a second direction opposite the first direction.

13. The method of claim 12, wherein two twisted strands are twisted together.

14. The method of claim 12, wherein more than two twisted strands are twisted together.

15. The method of claim 12, wherein each strand is produced by twisting the associated web into helical coils having a slope inclined to the longitudinal axis of the strand at an angle in the range of from about 45° to about 65°.

16. The method of claim 12, wherein each strand includes substantially equal lengths of web and support filament.

17. The method of claim 13, wherein the formation of each twisted strand is accomplished by feeding the web and support filament through a central bushing and into a rotating drum coaxial with the bushing.

18. The method of claim 12, wherein the twisting of plural twisted strands together is accomplished by feeding the plural twisted strands through a central bushing and into a rotating drum coaxial with the bushing.

* * * * *